US008342522B2

(12) United States Patent
Maeno

(10) Patent No.: US 8,342,522 B2
(45) Date of Patent: Jan. 1, 2013

(54) SHEET CONVEYANCE APPARATUS AND IMAGE FORMING APPARATUS

(75) Inventor: Masaki Maeno, Toride (JP)

(73) Assignee: Canon Kabshiki Kaisha, Tokyo (JP)

( * ) Notice: Subject to any disclaimer, the term of this patent is extended or adjusted under 35 U.S.C. 154(b) by 0 days.

(21) Appl. No.: 13/084,387

(22) Filed: Apr. 11, 2011

(65) Prior Publication Data

US 2011/0254218 A1 Oct. 20, 2011

(30) Foreign Application Priority Data

Apr. 14, 2010 (JP) ..... 2010-093355

(51) Int. Cl.
*B65H 5/02* (2006.01)
*B65H 29/20* (2006.01)

(52) U.S. Cl. ..... 271/272; 271/314

(58) Field of Classification Search ..... 271/272, 271/314

See application file for complete search history.

(56) References Cited

U.S. PATENT DOCUMENTS

2004/0178571 A1* 9/2004 Ohama et al. ..... 271/272

FOREIGN PATENT DOCUMENTS

JP 62-244846 A 10/1987

OTHER PUBLICATIONS

U.S. Appl. No. 12/965,774, filed Dec. 10, 2010.
U.S. Appl. No. 12/964,681, filed Dec. 9, 2010.
U.S. Appl. No. 12/945,598, filed Nov. 12, 2010.
U.S. Appl. No. 12/941,856, filed Nov. 18, 2010.
U.S. Appl. No. 12/834,651, filed Jul. 12, 2010.
U.S. Appl. No. 12/825,071, filed Jun. 28, 2010.
U.S. Appl. No. 12/958,245, filed Dec. 1, 2010.

* cited by examiner

*Primary Examiner* — David H Bollinger
(74) *Attorney, Agent, or Firm* — Canon U.S.A., Inc. IP Division

(57) ABSTRACT

A sheet conveyance apparatus includes a conveyance unit configured to convey a sheet and a pair of roller units, provided on a downstream of the conveyance unit in the conveyance direction, wherein the pair of roller units forms a plurality of nipping portions, arranged along a width direction orthogonal to the conveyance direction, a downstream end of the sheet to be conveyed is caused to abut against abutting positions of the plurality of nipping portion, and wherein the abutting position of the nipping portion nearer to a center in the width direction is positioned on a more downstream in the conveyance direction than the abutting position of the nipping portion at end side in the width direction.

7 Claims, 7 Drawing Sheets

SHEET CONVEYANCE APPARATUS AND IMAGE FORMING APPARATUS

BACKGROUND OF THE INVENTION

1. Field of the Invention

The present invention relates to a sheet conveyance apparatus that can correct a skew of a sheet and an image forming apparatus including the same.

2. Description of the Related Art

An electrophotographic copying machine forms a toner image and transfers the toner image onto a sheet in a transfer unit. Thereafter, the copying machine fixes the toner image onto the sheet by heating and pressurizing thereof. The conventional copying machine includes a skew correction unit for correcting a skew of the sheet at a position upstream in a conveyance direction of the transfer unit in order to transfer the toner image onto an accurate position of the sheet in the transfer unit.

Japanese Patent Application Laid-Open No. 62-244846 discusses a skew correction unit 55 including, as is illustrated in FIGS. 6A to 6C, a registration roller pair 56*a*, 56*b* (hereinafter sometimes referred to as registration roller pair 56) and a pre-registration roller pair 57*a*, 57*b* (hereinafter sometimes referred to as pre-registration roller pair 57) positioned upstream of the registration roller pair 56*a*, 56*b* in order to convey the sheet toward the registration roller pair 56*a*, 56*b*. A method for correcting the skew of the sheet by the skew correction unit 55 is described below with reference to FIGS. 6A to 6C.

FIG. 6A illustrates a state in which a sheet S is conveyed by a pre-registration roller pair 57*a*, 57*b*, and the sheet S is not yet at a nip portion of the registration roller pair 56*a*, 56*b*. At the time, the registration roller pair 56*a*, 56*b* is stopped without rotating.

The pre-registration roller pair 57*a*, 57*b* causes the sheet S to form a loop by causing the sheet S to abut against the nip portion of the registration roller pair 56*a*, 56*b*, as illustrated in FIG. 6B. As described above, since the skew correction unit 55 causes the sheet S to form the loop, in a case where the sheet S is skewed, a downstream end of the sheet S in a sheet conveyance direction is revolved along the nip portion of the registration roller pair 56*a*, 56*b* due to stiffness (i.e., elasticity) of the sheet S and, thereby, the skew of the sheet S is corrected.

As illustrated in FIG. 6C, the registration roller pair 56*a*, 56*b* rotates according to a timing at which the toner image is transferred onto the sheet S by the transfer unit. Accordingly, the sheet S is started to be conveyed while a leading edge of the sheet S is positioned along the nip portion of the registration roller pair 56*a*, 56*b*. The sheet S is conveyed to the transfer unit in a state in which the skew of the sheet S is corrected.

In a case where the conventional skew correction unit 55 executes the skew correction of a sheet having a high stiffness such as a thick paper, the following problem may occur. FIG. 7A illustrates a state before a skewed sheet S abuts against the nip portion of the registration roller pair 56*a*, 56*b*. FIG. 7A illustrates an abutting position 200 of the leading edge of the sheet S when the sheet S correctly abuts against the nip portions. In a case where the sheet S having high stiffness is conveyed in a skewed state, an abutting force concentrates at a portion (i.e., a position 201 of FIG. 7B) where the downstream end (i.e., leading edge) of the sheet S in the sheet conveyance direction firstly abuts against the nip portion of the registration roller pair 56.

Therefore, as illustrated in FIG. 7B, there is such a case that the leading edge of the sheet S is bitten into the nip portion of the registration roller pair 56 too much at a first abutting portion, and goes far beyond the position 200. When the pre-registration roller pair 57 continues to convey the sheet S while the sheet S is in the above described state, the sheet S is revolved with the leading edge of the sheet S still being bitten into the nip portion at the position 201 (i.e., the sheet S is revolved from a dotted line position to a solid line position).

Then, the downstream end of the sheet S in the sheet conveyance direction abuts against the nip portion of the roller positioned next to the roller by which the sheet S is bitten into as illustrated in FIG. 7C. At the time, since revolution of the sheet S is stopped by the roller positioned next thereto, the downstream end of the sheet S in the sheet conveyance direction cannot evenly abut against the nip portions of the registration roller pair 56.

As a result thereof, the skew correction unit 55 cannot cause the downstream end of the sheet S in the sheet conveyance direction to be positioned along the nip portions of the registration roller pair 56, and thus correction of the skew of the sheet S cannot be achieved. This problem frequently occurs when the skew correction is executed with respect to a sheet having high stiffness, e.g., a thick paper.

SUMMARY OF THE INVENTION

According to an aspect of the present invention, a sheet conveyance apparatus includes a conveyance unit configured to convey a sheet and a pair of roller units, provided downstream of the conveyance unit in a conveyance direction, wherein the pair of roller units forms a plurality of nipping portions, arranged along a width direction orthogonal to the conveyance direction, for nipping and thereby conveying the sheet, in a state that a rotation of the pair of roller is stopped, a downstream end of the sheet to be conveyed is caused to abut against abutting positions of the plurality of nipping portion to correct a skew of the sheet, and wherein the pair of roller units are configured so that the abutting position of the nipping portion nearer to a center in the width direction is positioned on a more downstream in the conveyance direction than the abutting position of the nipping portion at end side in the width direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
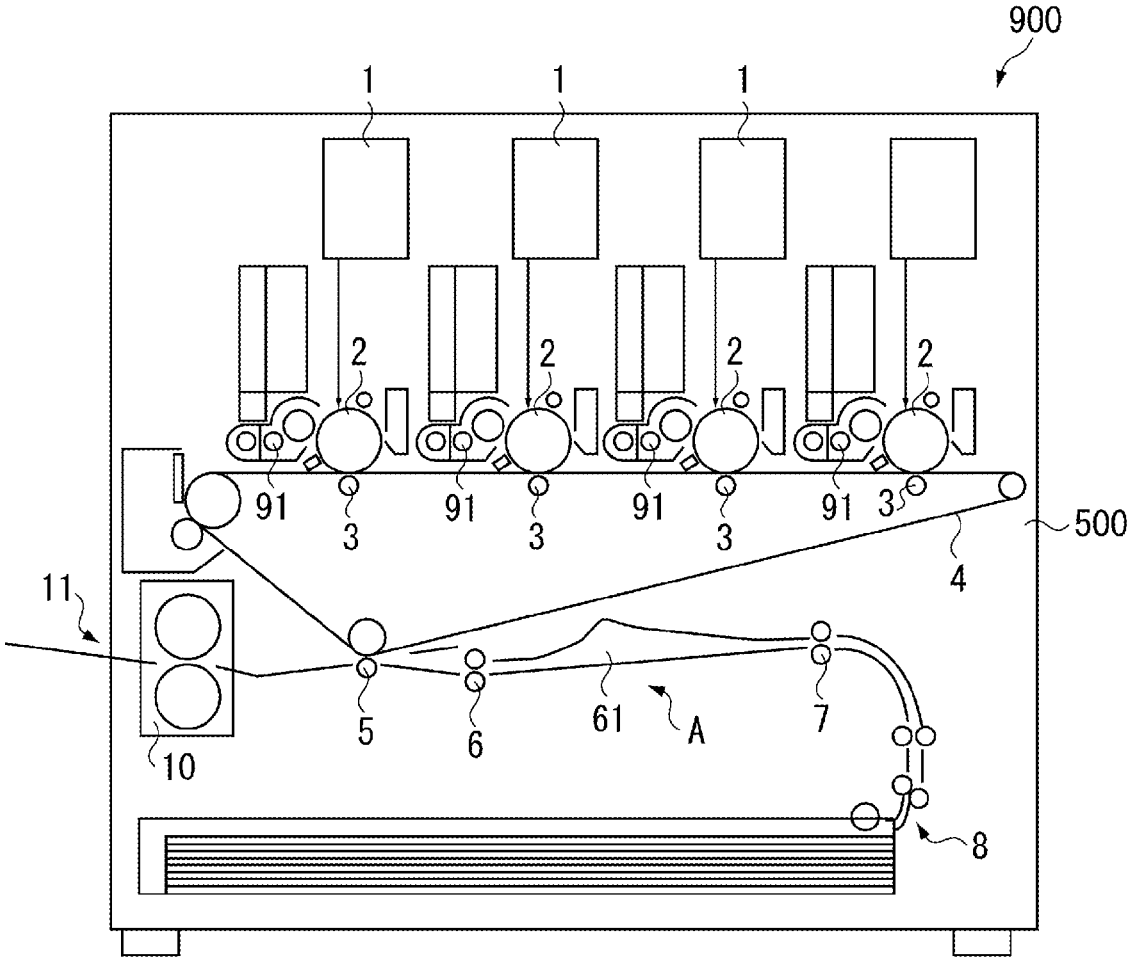
FIG. 1 is a whole view of an image forming apparatus according to an exemplary embodiment of the present invention.

FIG. 1 is a whole view of an image forming apparatus 900 including a sheet conveyance apparatus A of the present invention.

An image forming unit 500 configured to form an image has a below described configuration. The image forming unit 500 forms an electric image on a photosensitive drum 2 by a writing unit 1, and further forms a toner image via a development device 91. In FIG. 1, the writing unit 1, the photosensitive drum 2 and the development device 91 are combined to be a single assembly. Four assemblies, each having the above configuration, are arranged along a sheet conveyance direction. These four assemblies transfer a cyan toner image, a magenta toner image, a yellow toner image, and a black toner image onto an intermediate transfer member 4 in an overlapped manner from the photosensitive drums 2 by primary transfer rollers 3, respectively.

In the present exemplary embodiment, the leftmost assembly of FIG. 1 forms the cyan toner image. The next assembly forms the magenta toner image. The third assembly from the left in FIG. 1 forms the yellow toner image. The rightmost assembly of FIG. 1 forms the black toner image. This alignment order of the four assemblies is not limited to the above but may be changed, if required. The image forming unit 500 has a configuration as described above.

A paper feed unit 8 configured to feed a sheet to the image forming unit 500 is provided in a lower section of the image forming apparatus 900. The sheet that is separated piece by piece and fed from the paper feed unit 8 is subjected to a skew correction at the sheet conveyance apparatus A. Then, the sheet is conveyed to the image forming unit 500. In the image forming unit 500, the secondary transfer roller 5 transfers a toner image onto the sheet. Thus transferred image is fixed onto the sheet by heated and pressurized in the fixing unit 10. Then, the sheet with the fixed image is discharged via a sheet discharging unit 11.

Figure 2:
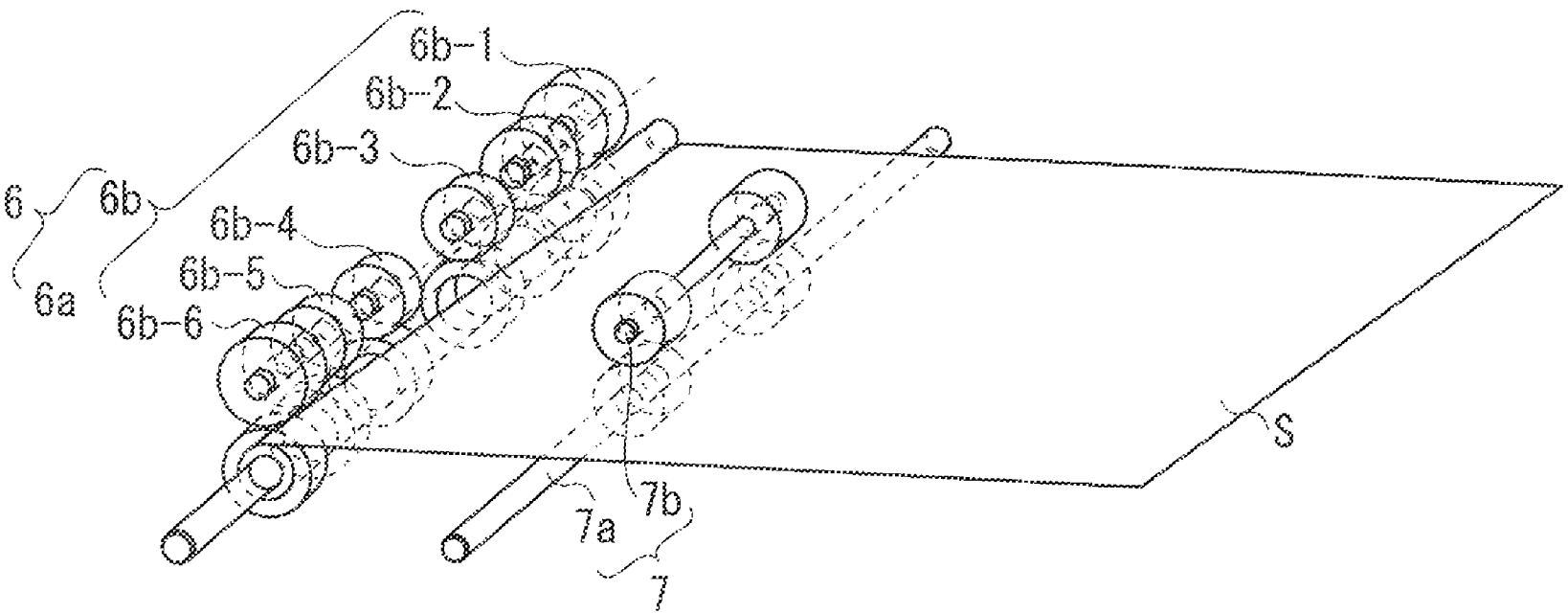
FIG. 2 is a perspective view of a sheet conveyance apparatus according to an exemplary embodiment of the present invention.

The sheet conveyance apparatus A of the present exemplary embodiment is positioned so as to convey the sheet from the paper feed unit 8 to the transfer unit 5 of the image forming unit 500. The sheet conveyance apparatus A corrects the skew of the sheet before the toner image is transferred onto the sheet at the transfer unit 5. FIG. 2 illustrates a schematic configuration of the sheet conveyance apparatus A according to the present exemplary embodiment.

The sheet conveyance apparatus A includes a registration roller pair 6 as a pair of roller units, a pre-registration roller pair 7 as a conveyance unit, and a registration loop space 61. The registration roller pair 6 as the pair of roller units includes a plurality of registration drive rollers 6*a* as a first roller unit that abut against one of surfaces (i.e., a lower surface) of the sheet, and a plurality of registration driven rollers 6*b* to be rotated by a friction force received via a peripheral surface of the registration drive rollers 6*a* or the sheet.

The registration drive rollers 6*a* are fixed to a drive shaft to which a driving force is transferred from a drive unit such as a motor (not illustrated), and can be rotated or stopped by the driving force from the drive unit. The registration driven rollers 6*b* as a first roller unit include registration driven rollers 6*b*-1 through 6*b*-6. The registration driven rollers 6*b*-1 through 6*b*-6 are positioned in series in a width direction orthogonal to the sheet conveyance direction, can be rotated independently to each other, and abut against another surface of the sheet.

Each of the registration driven rollers 6*b*-1 through 6*b*-6 is independently pressurized by a corresponding spring (not illustrated) against the corresponding one of the registration drive rollers 6*a*. The registration drive rollers 6*a* and the registration driven rollers 6*b*-1 through 6*b*-6 forms a plurality of nipping portions for nipping and thereby conveying the sheet.

Figure 3A:
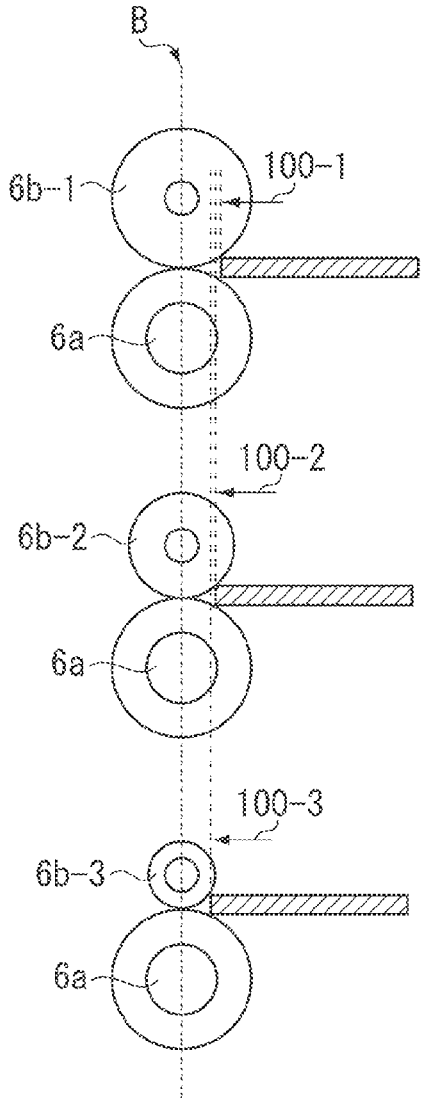
FIGS. 3A and 3B, respectively, illustrate each roller pair of a registration roller pair and an abutting position of a downstream end of a sheet in a sheet conveyance direction.
Figure 3B:
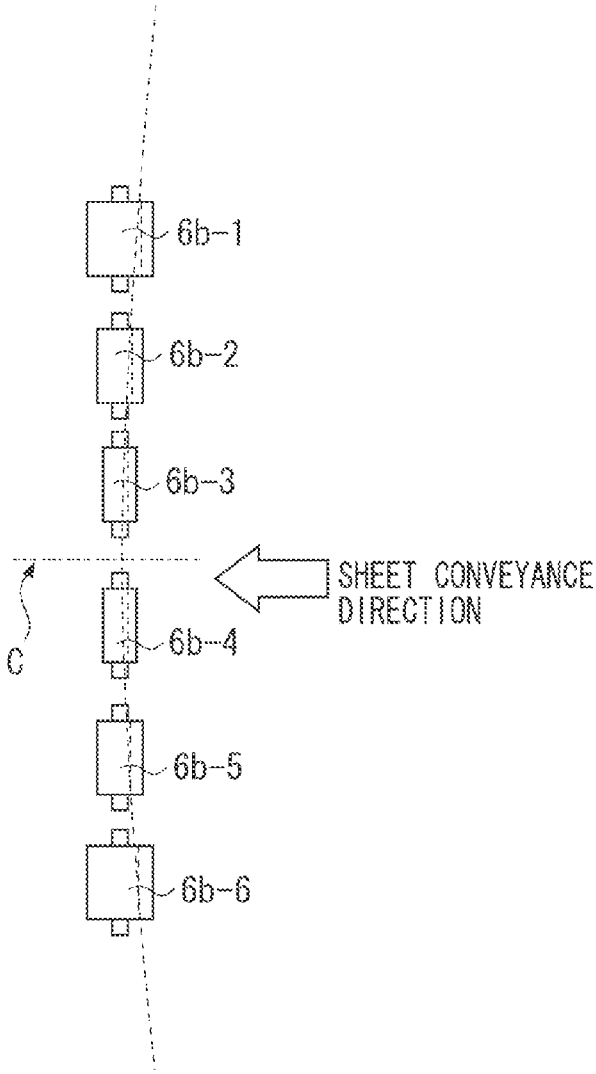

FIGS. 3A and 3B, respectively, illustrate the registration roller pair 6 in detail. FIG. 3A illustrates the registration roller pair 6 viewed from a drive shaft direction of the registration roller pair 6. In FIG. 3A, a line B connects rotation centers of the registration drive rollers 6*a* and rotation centers of the registration driven rollers 6*b*-1 through 6*b*-3. These lines overlap to each other viewed from the drive shaft direction of the registration roller pair 6. Although not illustrated, a line connecting the rotation centers of the registration drive rollers 6*a* with rotation centers of the registration driven rollers 6*b*-4 through 6*b*-6 also overlaps the line B.

FIG. 3B illustrates the registration driven rollers 6*b*-4 through 6*b*-6 viewed from a direction of the line B (i.e., from the above). The sheet conveyance apparatus A according to the present exemplary embodiment conveys the sheet so that a center C in the width direction orthogonal to the sheet conveyance direction in a sheet conveyance path and a center of the sheet in the width direction overlap to each other, thereby conveying the sheet with the center reference. In FIG. 3B, the line C indicates a sheet conveyance center as a center position of the sheet to be conveyed in the width direction orthogonal to the sheet conveyance direction.

Diameters of the registration driven rollers 6*b* are set in such manner that a diameter of the registration driven roller 6*b*-1 is set to R1, a diameter of the registration driven roller 6*b*-2 is set to R2, . . . , a diameter of the registration driven roller 6*b*-5 is set to R5, and a diameter of the registration driven roller 6*b*-6 is set to R6, respectively. As illustrated in FIGS. 3A and 3B, the registration driven rollers are configured so as to have a relationship of the diameters of "R1=R6>R2=R5>R3=R4". In other words, the registration driven rollers 6*b* are configured so that the registration driven rollers nearer to the sheet conveyance center C have a smaller diameter.

In FIG. 3A, an abutting position 100 is a position at which the downstream end of the sheet in the sheet conveyance direction starts to abut against both of the rollers of the registration roller pair 6 (i.e., an abutting position at which the downstream end of the sheet in the sheet conveyance direction abuts against both of the rollers of the registration roller pair 6). An abutting position 100-1 is a position at which the downstream end of the sheet in the sheet conveyance direction starts to abut against both of the registration driven roller 6*b*-1 and the corresponding registration drive roller 6*a*. An abutting position 100-2 is a position at which the downstream end of the sheet in the sheet conveyance direction starts to abut against both of the registration driven roller 6*b*-2 and the corresponding registration drive roller 6*a*.

An abutting position 100-3 is a position at which the downstream end of the sheet in the sheet conveyance direction starts to abut against both of the registration driven roller 6*b*-3 and the corresponding registration drive roller 6*a*. An abutting position 100-4 described below is positioned at a position identical to the abutting position 100-3 viewed from the rotation shaft direction of the registration roller pair 6. Similarly, an abutting position 100-5 described below is positioned at a position identical to the abutting position 100-2 viewed from the rotation shaft direction of the registration roller pair 6.

Further, an abutting position 100-6 described below is positioned at a position identical to the abutting position 100-1 viewed from the rotation shaft direction of the registration roller pair 6. Settings of the abutting positions 100-1 through 100-6 change according to a thickness of the sheet to be conveyed. More specifically, the abutting positions 100-1 through 100-6 are shifted to an upstream in the sheet conveyance direction as the thickness of the sheet to be conveyed is thicker.

The above described abutting position 100 and abutting positions 100-1 through 100-6 are positions at which the sheet starts to abut against rollers. When the sheet is actually abutted against the registration roller pair 6 by the pre-registration roller pair 7, the sheet is bitten a little into a space between the registration roller pair 6, and slightly shifts toward the downstream in the sheet conveyance direction than the above described abutting positions. As described in FIG. 3B, as the diameters of the registration driven rollers 6*b* are smaller, the abutting position at which the downstream end of the sheet in the sheet conveyance direction starts to abut against both rollers of the registration roller pair 6 is positioned downstream in the sheet conveyance direction.

Now, an operation of the skew correction performed by the sheet conveyance apparatus according to the present exemplary embodiment is described below. The sheet S fed out from the paper feed unit 8 is conveyed toward the registration roller pair 6 by the pre-registration roller pair 7. The registration roller pair 6 is stopped to wait for the sheet S.

Figure 4A:
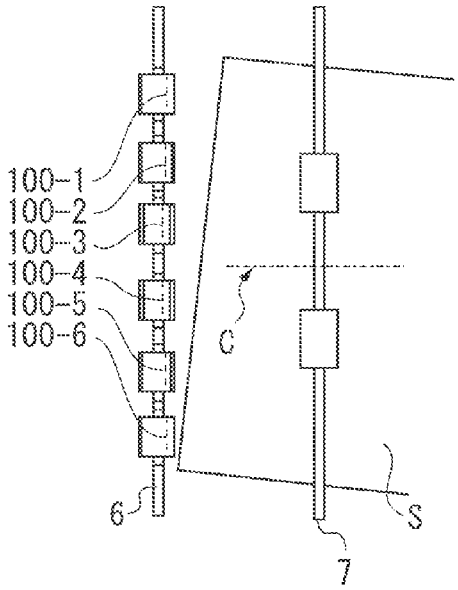
FIGS. 4A to 4C are schematic views illustrating a skew correction according to an exemplary embodiment of the present invention.

In a case where the sheet S is skewed in such a manner that a lower side of the sheet S goes ahead as illustrated in FIG. 4A, the downstream end of the sheet S in the sheet conveyance direction firstly abuts against a position between the registration driven roller 6*b*-6 farthest from the sheet conveyance center C and the corresponding registration drive roller 6*a* among the registration roller pair 6. Further, continuous conveyance of the sheet S by the pre-registration roller pair 7 forms a loop of the sheet S positioned between the registration roller pair 6 and the pre-registration roller pair 7.

The loop of the sheet S is formed within the registration loop space 61. The downstream end (i.e., the leading edge) of the sheet S in the sheet conveyance direction is revolved along the nip portions of the registration roller pair 6 and abuts against the nip portions of the registration roller pair 6 due to the stiffness of the sheet S. As a result thereof, the skew of the sheet S is corrected. Then, the registration roller pair 6 rotates according to a timing of a formation of an image by the image forming unit 500 and conveys the sheet S to the image forming unit 500.

Now, a case where the sheet S having high stiffness (i.e., elasticity) is skewed and abuts against a position between the registration driven roller 6*b*-6 farthest from the sheet conveyance center C and the corresponding registration drive roller 6*a* is described below.

Figure 4B:
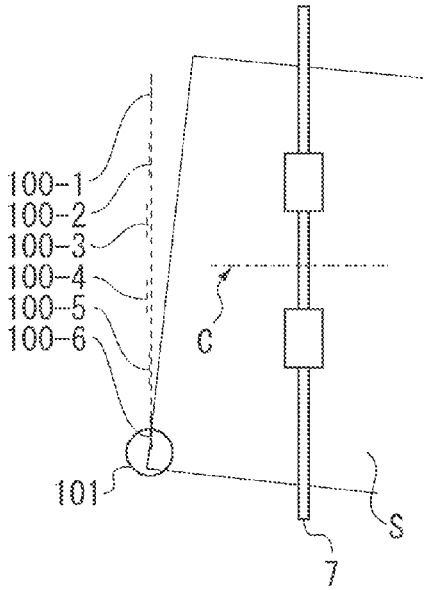

In this case, a relatively larger pressure is applied to the position between the registration driven roller 6*b*-6 and the corresponding registration drive roller 6*a* in comparison with a case where the sheet S is conveyed without being skewed and thus the sheet S evenly abuts against the whole position between the registration roller pair 6. At the time, the sheet S does not stop near the abutting position 100 of the downstream end of the sheet S in the sheet conveyance direction illustrated in FIG. 3B. Therefore, there is a case where, as illustrated by a position 101 of FIG. 4B, the downstream end of the sheet S in the sheet conveyance direction is bitten too much into a position between the registration driven roller 6*b*-6 and the corresponding registration drive roller 6*a*.

Figure 7A:
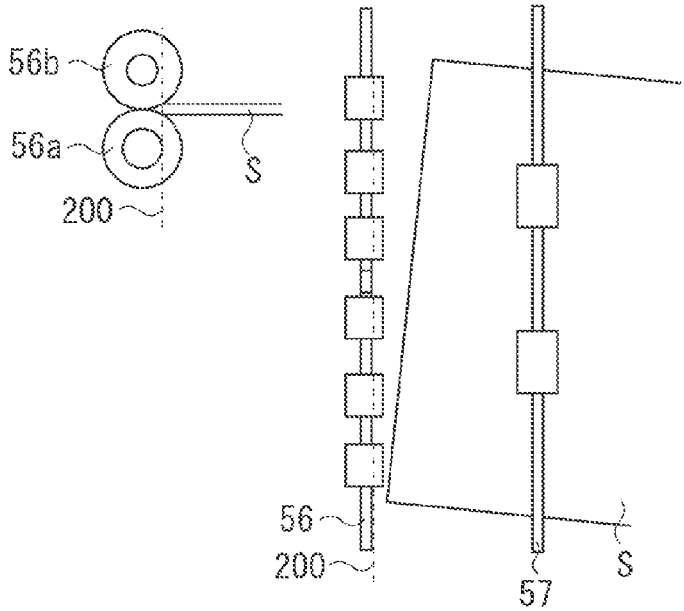
FIGS. 7A to 7C are schematic views illustrating the conventional skew correction method.
Figure 7B:
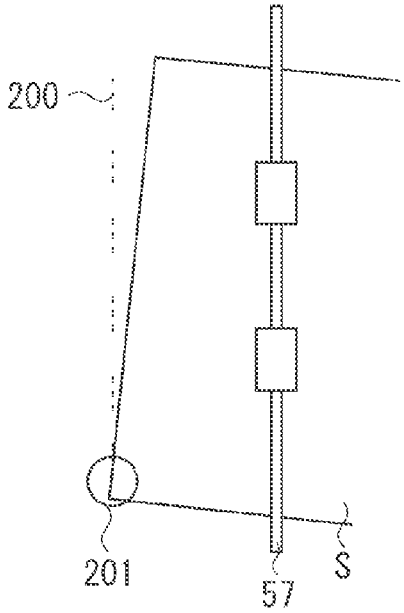
Figure 7C:
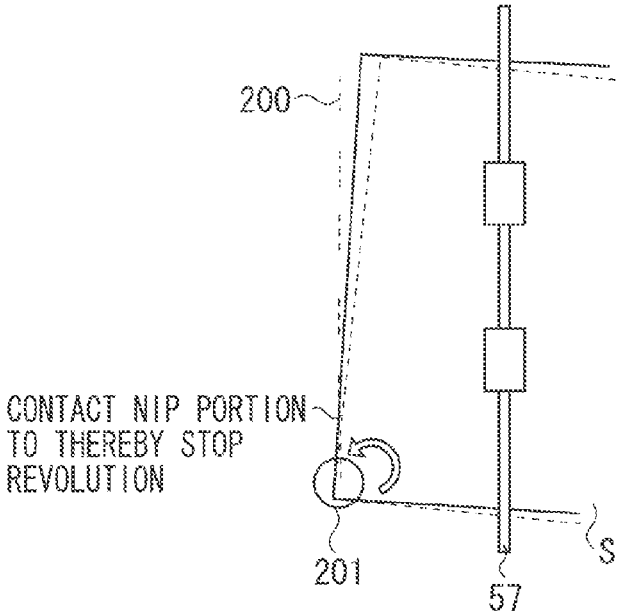

In the conventional sheet conveyance apparatus illustrated in FIGS. 7A through 7C, when the pre-registration roller pair 57 continues to convey the sheet S in the above-described state, the sheet S is revolved while the bitten state of the sheet S at the position 201 is not released (i.e., the sheet S is revolved from the dotted line position to the solid line position). Then, the downstream end of the sheet S in the sheet conveyance direction abuts against the nip portion of the roller positioned next to the roller by which the sheet S is bitten into as it is illustrated in FIG. 7C.

At this time, revolution of the sheet S is stopped by the roller positioned next, so that the downstream end of the sheet S in the sheet conveyance direction cannot evenly abut against the nip portions of the registration roller pair 56. As a result thereof, the skew correction unit 55 cannot perform a sufficient correction of the skew of the sheet S.

Figure 4C:
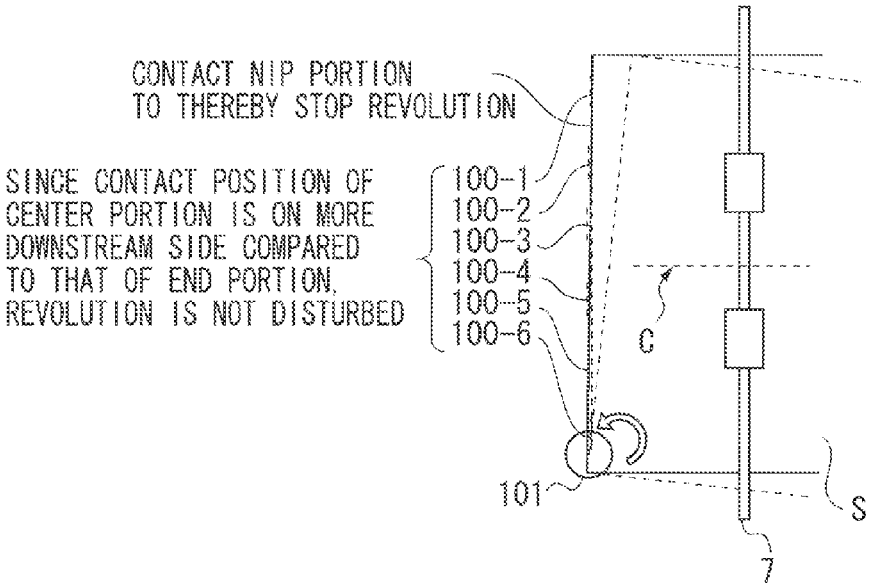

On the other hand, as illustrated in FIG. 4C, in the present exemplary embodiment, the diameter of each roller of the registration driven rollers 6*b* is smaller as the roller is nearer to the sheet conveyance center C. Therefore, in the abutting positions 100-1 through 100-6 at which the sheet S starts to abut against both of the registration drive rollers 6*a* and the registration driven rollers 6*b*, the rollers nearer to the sheet conveyance center C are positioned downstream in the sheet conveyance direction.

In a case where the sheet S is bitten too much, if an amount of biting is smaller than a distance in the conveyance direction between the abutting position 100-6 and the abutting position 100-5 next to the abutting position 100-6, the revolution of the sheet S is stopped at a position where the sheet S abuts against the abutting position 100-1 and moves slightly downstream.

The abutting position 100-1 is positioned, as described above, at the position identical to the abutting position 100-6 viewed from the rotation shaft direction of the registration roller pair 6. As a result thereof, in the present exemplary embodiment, even in a case where the sheet S is bitten too much into the position between one of the registration driven rollers and the corresponding registration drive roller 6*a*, more accurate skew correction can be achieved.

In a case where the amount of biting is larger than a distance in the conveyance direction between the abutting position 100-6 and the abutting position 100-5 next to the abutting position 100-6, the revolution of the sheet S is stopped because the sheet S abuts against a position between the registration driven roller 6*b*-5 and the corresponding registration drive roller 6*a*. However, in comparison with a case where all the registration driven rollers have the same diameter, the position where the revolution of the sheet S stops comes to be more downstream. As a result thereof, in the present exemplary embodiment, more accurate skew correction can be performed than the conventional skew correction technique.

There is a case where the sheet S that has a narrower width and that abuts against the abutting positions 100-2 through 100-5 without abutting against the abutting positions 100-1 and the 100-6 is conveyed. In this case, also, the abutting positions 100-3 and the 100-4 relatively nearer to the center in the width direction orthogonal to the sheet conveyance direction are positioned downstream in the sheet conveyance direction than the abutting positions 100-2 and 100-5, so that more accurate skew correction can be realized than the conventional technique as described above. In above mentioned embodiment, a plurality of registration drive rollers 6*a* is arranged on a line along to the width direction, but it can be formed that one registration drive roller of the registration roller pair 6 which has a shape that continues at the same diameter in the width direction is arranged.

Figure 5:
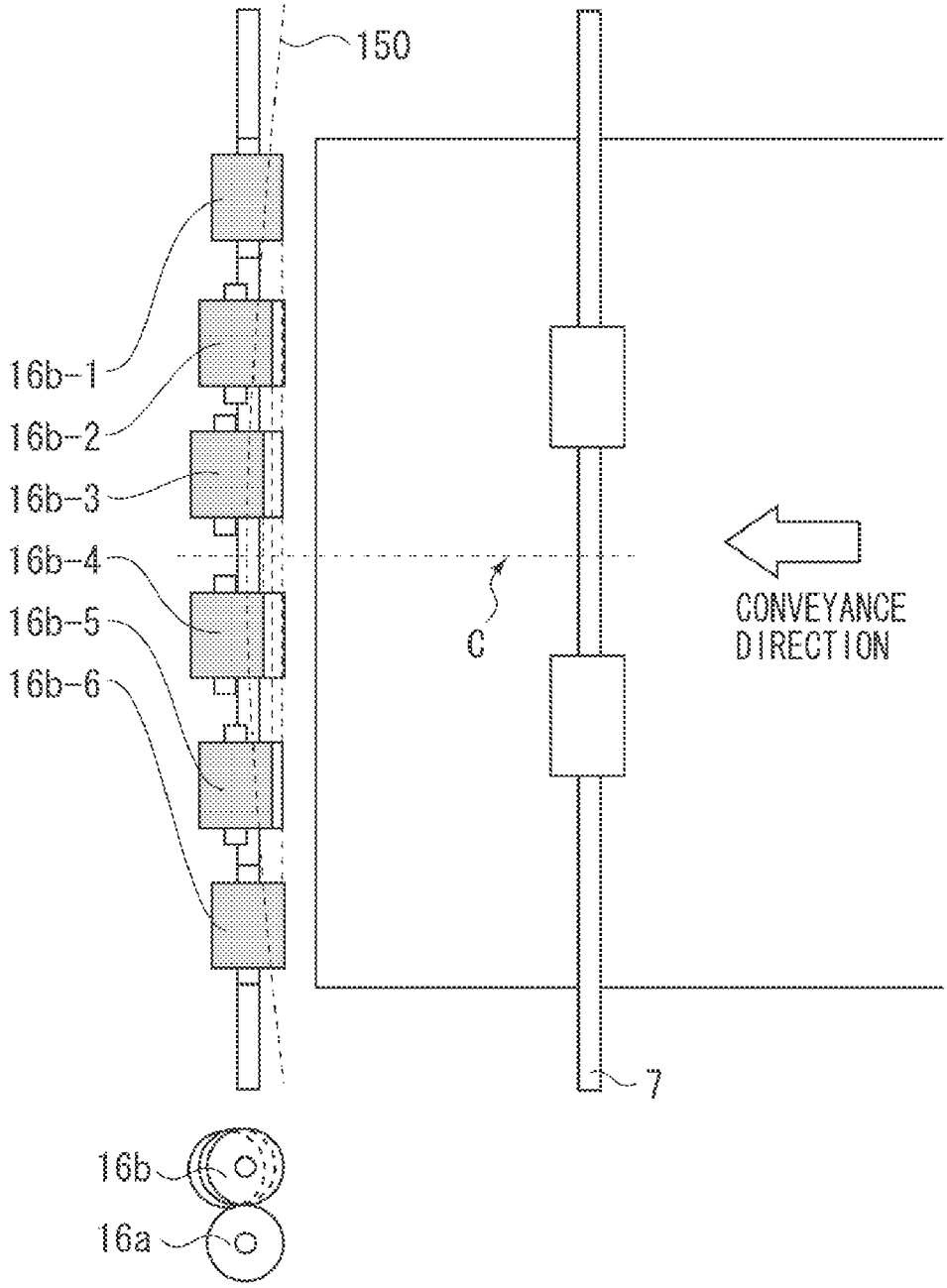
FIG. 5 illustrates a sheet conveyance apparatus according to another exemplary embodiment of the present invention.
Figure 6A:
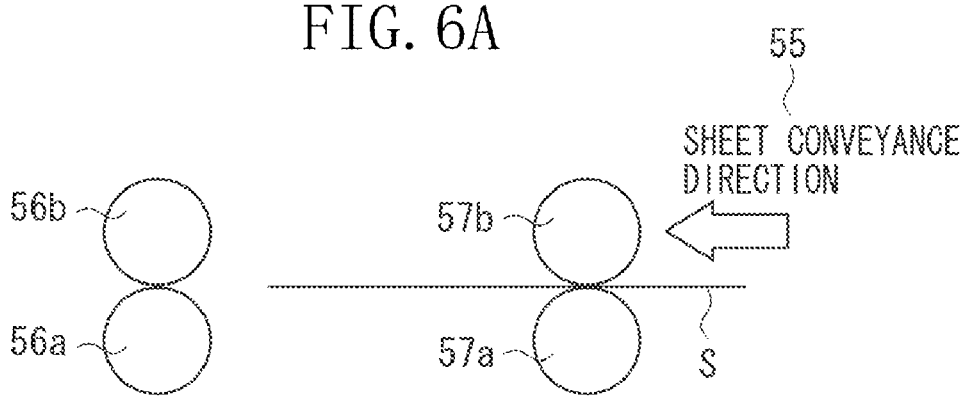
FIGS. 6A to 6C illustrate a loop formation skew correction conveyance method.
Figure 6B:
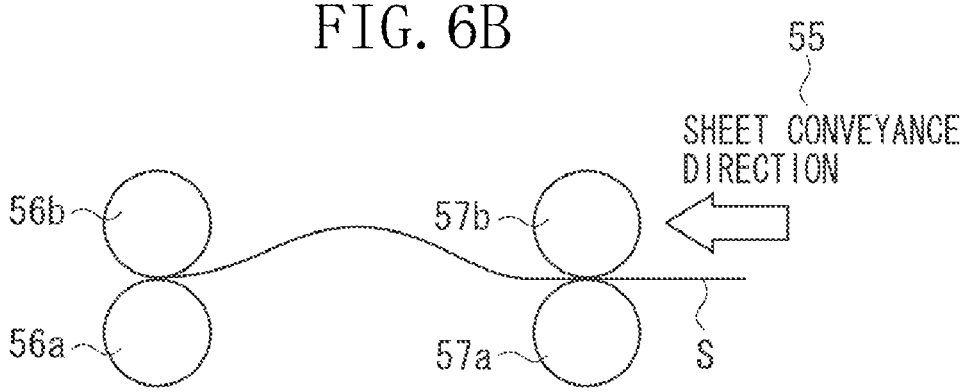
Figure 6C:
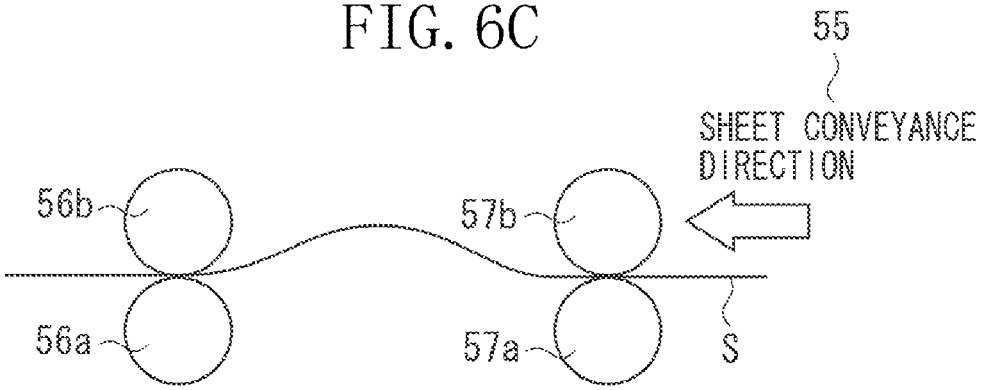

In addition to the configuration that the registration driven roller nearer to the sheet conveyance center has smaller diameter, for example, as illustrated in FIG. 5, such a configuration may also be employed that the registration driven rollers **16*b*-1 through 16*b*-6** having the same diameter are positioned in such a manner that the roller nearer to the sheet conveyance center C is positioned more downstream in the sheet conveyance direction.

In this case, also, as illustrated in FIG. 5, the abutting position 150 of the downstream end of the sheet S in the sheet conveyance direction is positioned downstream in the sheet conveyance direction as the abutting position 150 is nearer to the sheet conveyance center C. Therefore, an effect identical to the effect of the above described exemplary embodiment can be produced. Further, such a configuration that the registration driven rollers nearer to the above described sheet conveyance center C have a smaller diameter may be employed together with the above configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-093355 filed Apr. 14, 2010, which is hereby incorporated by reference herein in its entirety.

What is claimed is:

1. A sheet conveyance apparatus comprising:

a conveyance unit configured to convey a sheet; and a pair of roller units provided on a downstream of the conveyance unit in a conveyance direction, wherein one roller unit of the pair of roller units is a drive roller, and the other roller unit of the pair of roller units includes a plurality of driven rollers each pressurized against the drive roller, wherein the pair of roller units forms a plurality of nipping portions, arranged along a width direction orthogonal to the conveyance direction, for nipping and thereby conveying the sheet, in a state that a rotation of the pair of roller is stopped, a downstream end of the sheet to be conveyed is caused to abut against abutting positions of the plurality of nipping portion to correct a skew of the sheet, and wherein the driven rollers nearer to a center in the width direction have a smaller diameter than the driven rollers at both end sides in the width direction so that the abutting position of the nipping portion nearer to a center in the width direction is positioned on a more downstream in the conveyance direction than the abutting position of the nipping portion at end side in the width direction.

2. The apparatus according to claim 1, wherein the driven rollers nearer to a center in the width direction are positioned on a more downstream in the conveyance direction than the driven rollers at both end sides in the width direction.

3. An image forming apparatus comprising:

the sheet conveyance apparatus according to claim 1; and an image forming unit configured to form an image onto the sheet to be conveyed by the sheet conveyance apparatus.

4. A sheet conveyance apparatus comprising:

a conveyance unit configured to convey a sheet;

a drive roller provided on a downstream of the conveyance unit in a conveyance direction; and a plurality of driven rollers, pressurized against the drive roller, aligned in a width direction orthogonal to the conveyance direction, wherein a downstream end of the sheet to be conveyed is caused to abut against the drive roller and the plurality of driven rollers of which rotations are stopped to correct a skew of the sheet, and wherein the driven roller nearer to a center in the width direction has a smaller diameter than the driven rollers of both end sides in the width direction.

5. An image forming apparatus comprising:

the sheet conveyance apparatus according to claim 4; and an image forming unit configured to form an image onto the sheet to be conveyed by the sheet conveyance apparatus.

6. A sheet conveyance apparatus comprising:

a conveyance unit configured to convey a sheet;

a drive roller provided on a downstream of the conveyance unit in a conveyance direction; and a plurality of driven rollers, pressurized against the drive roller, aligned in a width direction orthogonal to the conveyance direction, wherein the plurality of driven rollers are parallel to one another, wherein a downstream end of the sheet to be conveyed is caused to abut against the drive roller and the plurality of driven rollers of which rotations are stopped to correct a skew of the sheet, and wherein the driven roller nearer to a center in the width direction is positioned on a more downstream in the conveyance direction than the driven rollers of both end sides in the width direction.

7. An image forming apparatus comprising:

the sheet conveyance apparatus according to claim 6; and an image forming unit configured to form an image onto the sheet to be conveyed by the sheet conveyance apparatus.

* * * * *

UNITED STATES PATENT AND TRADEMARK OFFICE

CERTIFICATE OF CORRECTION

PATENT NO. : 8,342,522 B2
APPLICATION NO. : 13/084387
DATED : January 1, 2013
INVENTOR(S) : Masaki Maeno It is certified that error appears in the above-identified patent and that said Letters Patent is hereby corrected as shown below:

Title Page, Item (73)

Name of the Assignee should be:

CANON KABUSHIKI KAISHA

Signed and Sealed this
Twenty-eighth Day of May, 2013

Teresa Stanek Rea

Teresa Stanek Rea
*Acting Director of the United States Patent and Trademark Office*